US011889924B2

(12) United States Patent
Song

(10) Patent No.: US 11,889,924 B2
(45) Date of Patent: Feb. 6, 2024

(54) MODULAR SECTIONAL SOFA

(71) Applicant: Tongpei Song, Shandong Province (CN)

(72) Inventor: Tongpei Song, Shandong Province (CN)

( * ) Notice: Subject to any disclaimer, the term of this patent is extended or adjusted under 35 U.S.C. 154(b) by 0 days.

(21) Appl. No.: 18/068,632

(22) Filed: Dec. 20, 2022

(65) Prior Publication Data

US 2023/0210267 A1 Jul. 6, 2023

(30) Foreign Application Priority Data

Jan. 6, 2022 (CN) ..... 202220016092.2

(51) Int. Cl.
*A47C 13/00* (2006.01)
*A47C 17/16* (2006.01)

(52) U.S. Cl.
CPC ..... *A47C 17/161* (2013.01); *A47C 17/162* (2013.01)

(58) Field of Classification Search
CPC ... A47C 17/161; A47C 17/162; A47C 17/163; A47C 17/04; A47C 17/34; A47C 13/005
See application file for complete search history.

(56) References Cited

U.S. PATENT DOCUMENTS 2,059,397 A * 11/1936 Robinson, Sr. ..... A47C 17/34 297/63
3,973,800 A * 8/1976 Kogan ..... A47C 7/002 297/135
4,591,289 A * 5/1986 Vickers ..... A47B 87/002 292/249
5,344,216 A * 9/1994 Suominen ..... A47C 1/023 297/383
5,517,706 A * 5/1996 Kashima ..... A47C 17/165 5/52
6,264,271 B1 * 7/2001 Munn ..... A47C 4/286 297/372

(Continued)

*Primary Examiner* — Justin C Mikowski
*Assistant Examiner* — Ifeolu A Adeboyejo

(57) ABSTRACT

The present disclosure provides a modular sectional sofa, including a bottom frame, a backrest frame and a cushion, wherein the inner side surface of the backrest frame is provided with a hook body, the hook body comprises a connection element, the lower surface of the connection element is provided with an inserting part, the upper surface of the bottom frame is provided with a hole or slot, when the inserting part is connected to the hole or slot, the backrest frame is connected with the bottom frame into a whole. A modular sectional sofa is further provided, including a bottom frame and a U-shaped connection element, wherein the U-shaped connection element connects two bottom frames through a left position limiting post and a right position limiting post. A modular sectional sofa is further provided, the side edge on the upper surface of the bottom frame is provided with four holes or slots, and the hook body on the inner side surface of the backrest frame are connected in any two holes or slots, and the backrest frame is connected with any side of the bottom frame. This reduces the size and the weight of sofa to improve the convenience of sofa handling. There are a variety of combinations. The present disclosure is strongly stable after assemble and convenient for people to use.

12 Claims, 14 Drawing Sheets

(56) References Cited

U.S. PATENT DOCUMENTS 7,387,344 B2 * 6/2008 Yu ..... A47C 4/028 297/440.1
7,494,182 B2 * 2/2009 Westendorf ..... A47C 17/86 297/188.1
11,297,949 B1 * 4/2022 Galjour ..... A47C 4/028
11,457,745 B1 * 10/2022 Clabots ..... A47C 13/005
2002/0017814 A1 * 2/2002 Niederman ..... A47C 4/028 297/440.16
2004/0021359 A1 * 2/2004 Chang ..... A47C 4/024 297/440.15
2005/0179303 A1 * 8/2005 Owens ..... A47C 7/42 297/440.1
2006/0279124 A1 * 12/2006 White, III ..... A47C 13/005 297/440.14
2009/0045666 A1 * 2/2009 Westendorf ..... A47C 13/005 297/440.1
2011/0298340 A1 * 12/2011 Nelson ..... A47C 3/029 312/107
2015/0196122 A1 * 7/2015 Lu ..... A47C 1/026 297/383
2016/0174722 A1 * 6/2016 Huang ..... A47C 1/023 297/383
2016/0206109 A1 * 7/2016 Nault ..... A47C 17/18
2017/0367486 A1 * 12/2017 Nelson ..... A47C 13/005
2018/0000244 A1 * 1/2018 Nelson ..... A47C 13/005
2018/0213943 A1 * 8/2018 Kuhl ..... A47C 13/005
2019/0223606 A1 * 7/2019 Hesse ..... A47C 17/04
2020/0187654 A1 * 6/2020 Mutyala ..... F16B 12/60
2020/0221877 A1 * 7/2020 Hirschhaut ..... A47C 17/04
2020/0268160 A1 * 8/2020 Kuhl ..... A47C 17/86
2020/0375362 A1 * 12/2020 Hale ..... A47C 17/04
2021/0068547 A1 * 3/2021 Hodgson ..... A47C 7/42
2022/0000266 A1 * 1/2022 Nelson ..... A47C 13/005
2022/0240678 A1 * 8/2022 Stack ..... A47C 13/005
2023/0066786 A1 * 3/2023 Zhao ..... A47C 17/34

* cited by examiner

MODULAR SECTIONAL SOFA

TECHNICAL FIELD

The present disclosure relates to the technical field of furniture, especially a modular sectional sofa.

BACKGROUND

At present, most sofas are designed in one piece, and the armrests and backrest frame cannot be disassembled, so most sofas are larger, making it very inconvenient to move and transport. To meet the different requirements of sofa in terms of the length, sizes, shapes and combinations, the manufacturer needs to manage many products. Besides, the costs of raw materials and other expenditure is high. Therefore, it is necessary to design a sofa that can meet the diversified requirements at lower costs.

SUMMARY

The present disclosure provides a modular sectional sofa to solve the problems of the above-mentioned prior art, which can reduce the size and the weight of sofa to improve the convenience of sofa handling and transporting. Moreover, there are a variety of combinations. The present disclosure is strongly stable after assemble and convenient for people to use.

The technical solutions adopted by the present disclosure for solving the technical problem thereof are as follows:

A modular sectional sofa, including a bottom frame, a backrest frame and a cushion, wherein the inner side surface of the backrest frame is provided with a hook body, the hook body comprises a connection element, the lower surface of the connection element is located at the same height as the upper surface of the bottom frame, the lower surface of the connection element is provided with an inserting part, the upper surface of the bottom frame is provided with a hole or slot, the hole or slot matches with the inserting part, when the inserting part is connected to the hole or slot, the backrest frame is connected with the bottom frame into a whole, and the cushion is detachably placed on the bottom frame.

Further, at least two hook bodies are provided, and the hook bodies are respectively distributed on two sides of the inner side surface of the backrest frame.

Further, the bottom surface of the bottom frame is provided with a first supporting leg, and the bottom surface of the backrest frame is provided with a second supporting leg.

Further, the bottom surface of the bottom frame is provided with a position limiting piece, the position limiting piece is provided with a left position limiting hole and a right position limiting hole, the right position limiting hole is movably mounted on the bottom surface of the bottom frame, and the left position limiting hole is fixed on the bottom surface of the backrest frame through second supporting leg.

Further, the upper surface of the position limiting piece is located at the same height as the bottom surface of the backrest frame.

Further, it further comprises a rotating shaft, and the right position limiting hole is movably mounted on the bottom surface of the bottom frame through the rotating shaft.

Further, the backrest frame comprises one or more of a left backrest frame, a right backrest frame and a rear backrest frame.

Further, the upper part of the backrest frame is a backrest, and the angle of the backrest is adjustable.

Further, the bottom frame is provided with a storage space.

Further, the storage space is provided in the bottom frame, and the edge of the storage space can be used as the hole or the slot. The bottom frame is properly covered with the cushion, and the cushion covers the storage space.

Further, a support frame is movably provided in the storage space, and when the cushion is supported up by the support frame, the storage space is opened.

A modular sectional sofa is further provided, including bottom frames and a U-shaped connection element, wherein the U-shaped connection element is provided with a left position limiting post and a right position limiting post, the left position limiting post is inserted into a hole or a slot of a bottom frame, the right position limiting post is inserted into a hole or a slot of the other bottom frame, and the U-shaped connection element connects the two bottom frames.

Further, a plurality of bottom frames is connected through the U-shaped connection element to form a sofa set.

A modular sectional sofa is further provided, including a bottom frame and a backrest frame, wherein the side edge of the bottom frame is provided with four holes, namely a first hole, a second hole, a third hole and a fourth hole; the inner side surface of the backrest frame is provided with two hook bodies that are inserted into any two holes or slots, and the backrest frame is connected with any one side of the bottom frame.

The advantageous effects of the present application are that:

By using the above technical solutions, the modular sectional sofa of the present disclosure separates the one-piece bottom frame and backrest frame in the conventional sofa, and then various combinations are realized by adding hook body on the inner side surface of the backrest frame. As the connection element of the hook body is as high as the bottom frame, the hook body will not affect the placing of the cushion on the bottom frame. The size and the weight of sofa are reduced to improve the convenience of sofa handling and transporting. Moreover, it is easier to move the sofa after disassembling to clean the house.

Secondly, the present disclosure is further provided with a U-shaped connection element, wherein the U-shaped connection element is provided with a left position limiting post and a right position limiting post, the left position limiting post is inserted into a hole or a slot of a bottom frame, the right position limiting post is inserted into a hole or a slot of the other bottom frame, and two bottom frames are connected together through the position limiting piece, so as to connect a plurality of bottom frames and prevent the bottom frames from disassembling due to vertical or lateral movement, resulting in the user's fall and injury.

In addition, in the present disclosure, the side edge of the upper surface of the bottom frame is provided with four holes or slots; the inner side surface of the backrest frame is provided with two hook bodies; the backrest frame is connected with the bottom frame in a manner that two hook bodies are inserted into the two adjacent holes or slots, which enables the user to flexibly adjust the installation position of the backrest frame. improves the versatility of the backrest frame and solves the problem that the installation cannot be finished due to the fact that the left backrest frame or the right backrest frame is overlapped with the rear backrest frame.

BRIEF DESCRIPTION OF THE DRAWINGS

The present disclosure will be further explained below with reference to the accompanying drawings and embodiments.

Reference signs: 1. bottom frame; 11. first supporting leg; 2. backrest frame; 21. hook body; 211. connection element; 212. inserting part; 22. second supporting leg; 23. backrest; 24. support frame; 3. cushion; 4. position limiting piece; 41. left position limiting hole; 42. second position limiting hole; 5. U-shaped connection element; 51. left position limiting post; 52. right position limiting post; 61. first hole; 62. second hole; 63. third hole; 64. fourth hole.

DETAILED DESCRIPTION OF THE PREFERRED EMBODIMENT

The following clearly and completely describes the technical solutions in the embodiments of the present disclosure with reference to the accompanying drawings in the embodiments of the present disclosure. The described embodiments are some rather than all of the embodiments of the present disclosure. All other embodiments that can be obtained by a person skilled in the art based on the embodiments of the present disclosure without any creative effort are included in the protection scope of the present disclosure.

Figure 1:
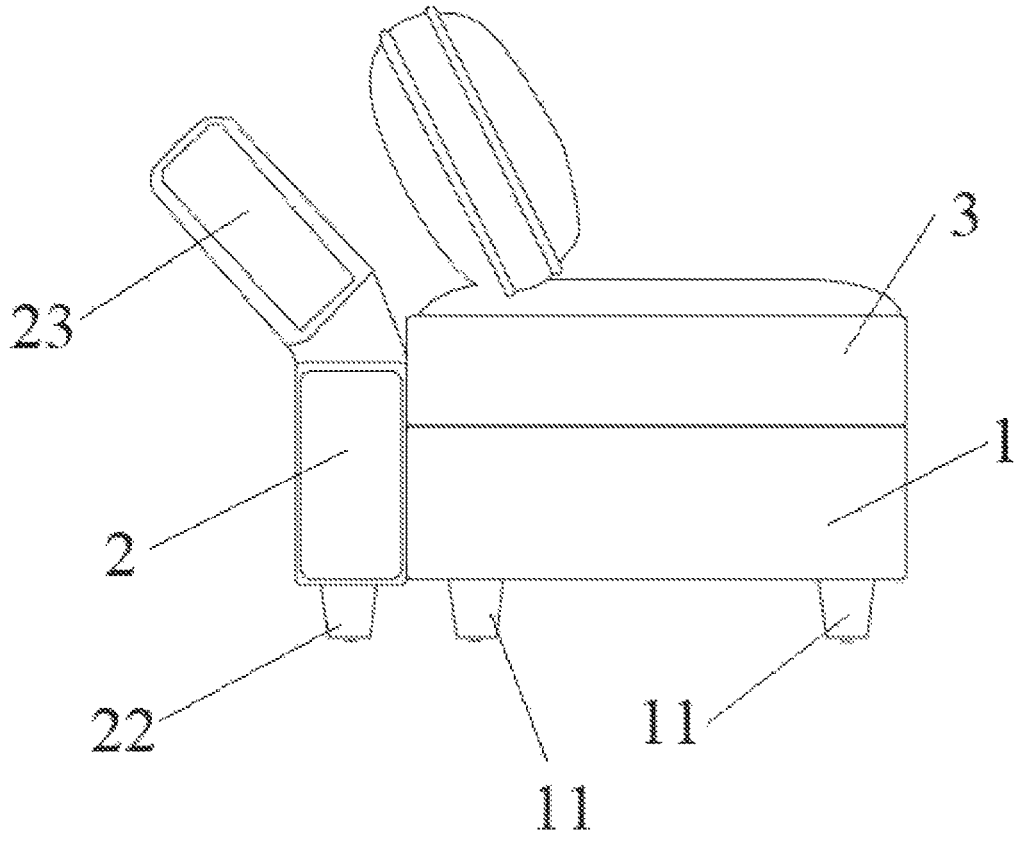
FIG. 1 is a schematic view of the structure of a modular sectional sofa of the present disclosure.
Figure 2:
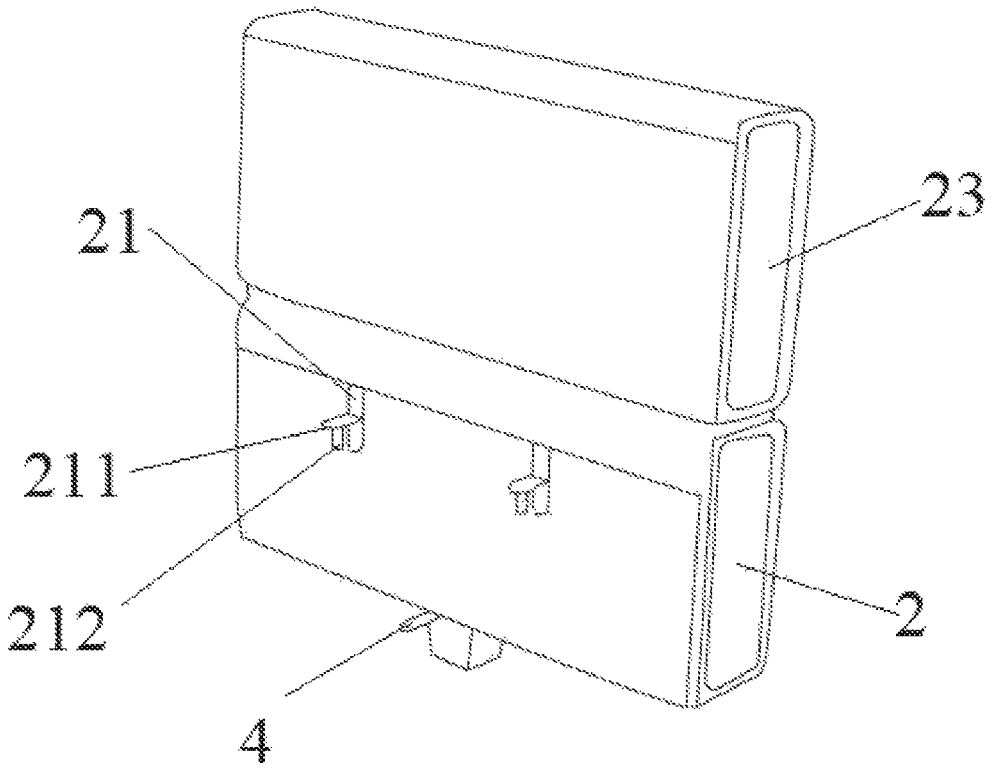
FIG. 2 is a schematic view of the structure of a backrest frame of the present disclosure in a first state.
Figure 3:
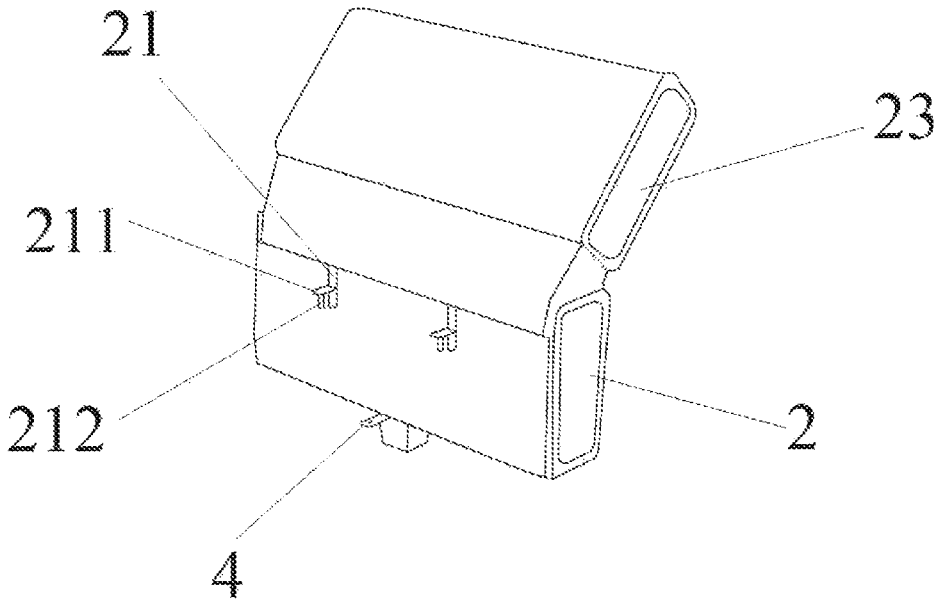
FIG. 3 is a schematic view of the structure of a backrest frame of the present disclosure in a second state.
Figure 4:
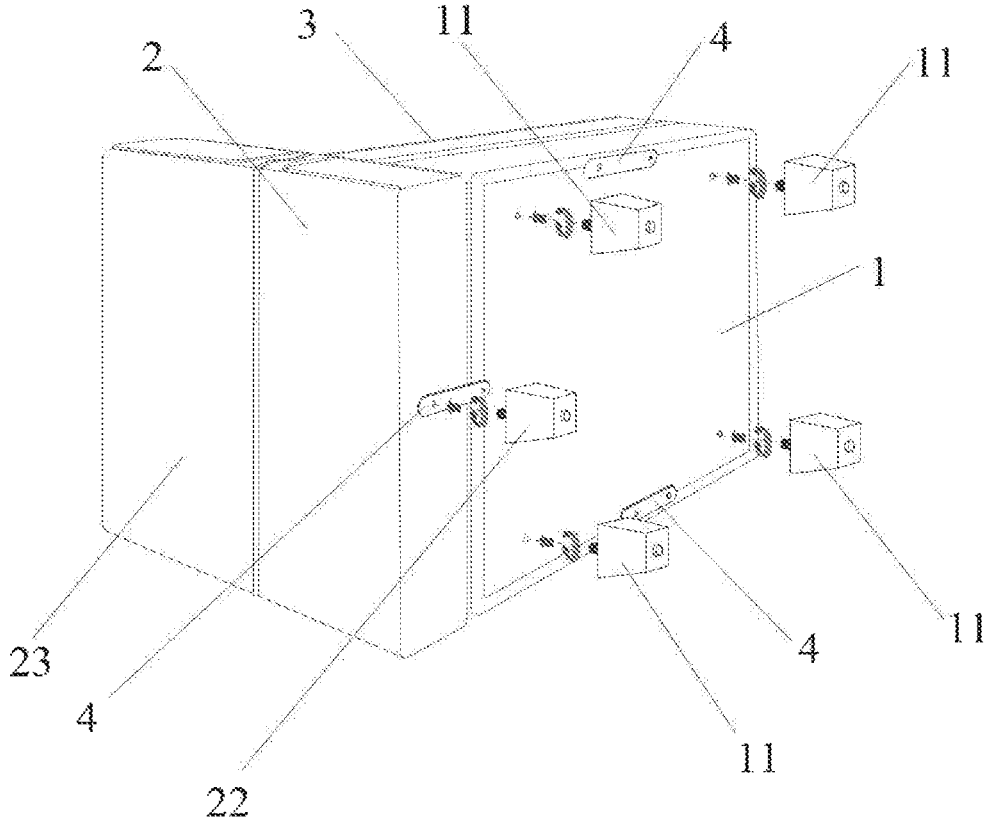
FIG. 4 is a side view of the connection structure of the backrest frame and the bottom frame of the present disclosure.
Figure 5:
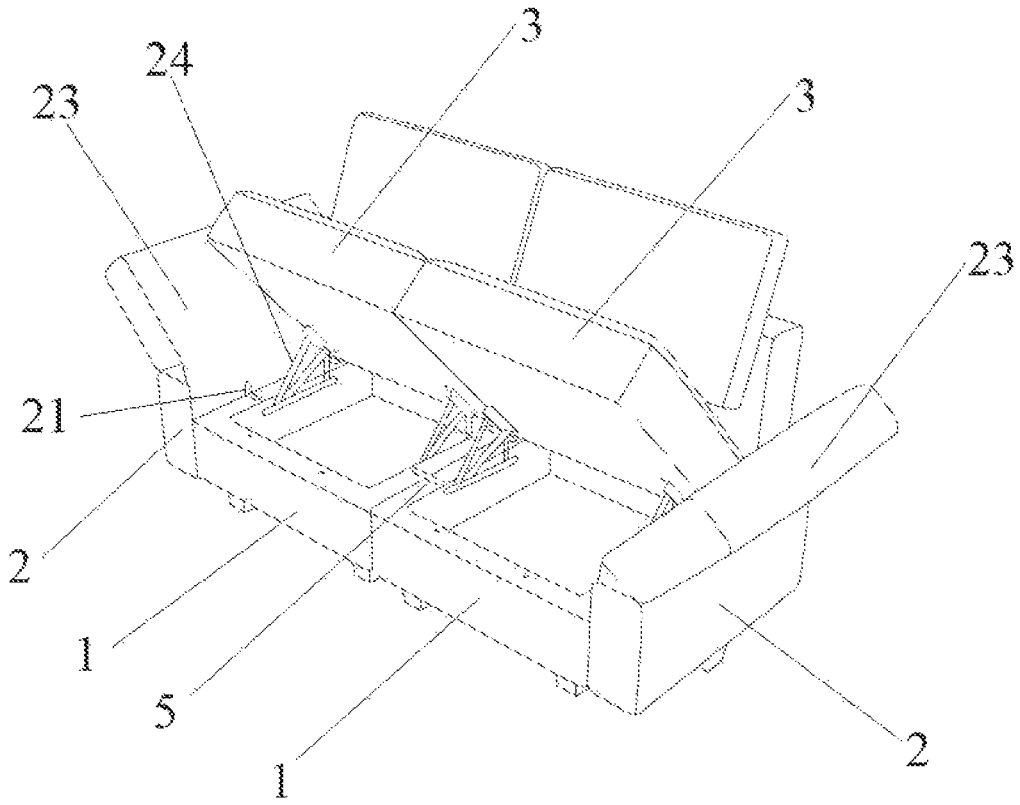
FIG. 5 is a schematic view of the splicing structure of two bottom frames of the present disclosure.
Figure 6:
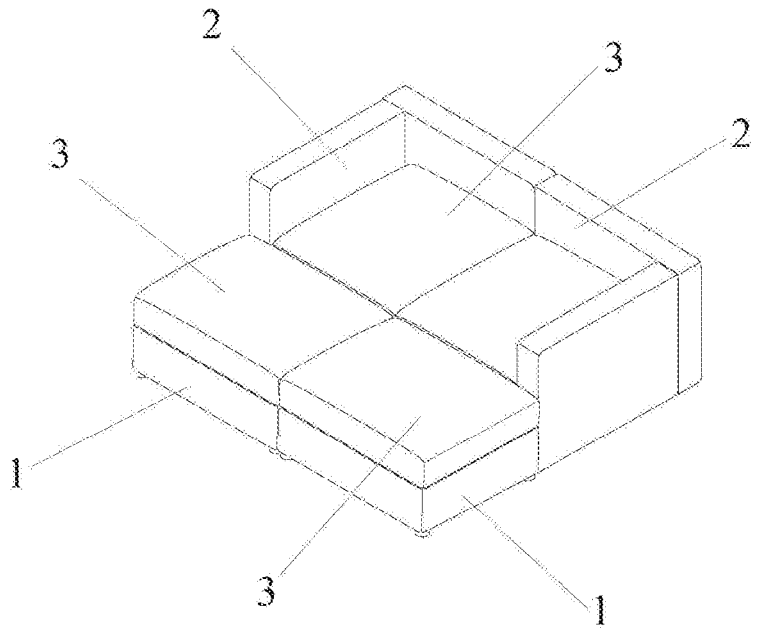
FIG. 6 is a schematic view of the structure of the first embodiment of the present disclosure.
Figure 7:
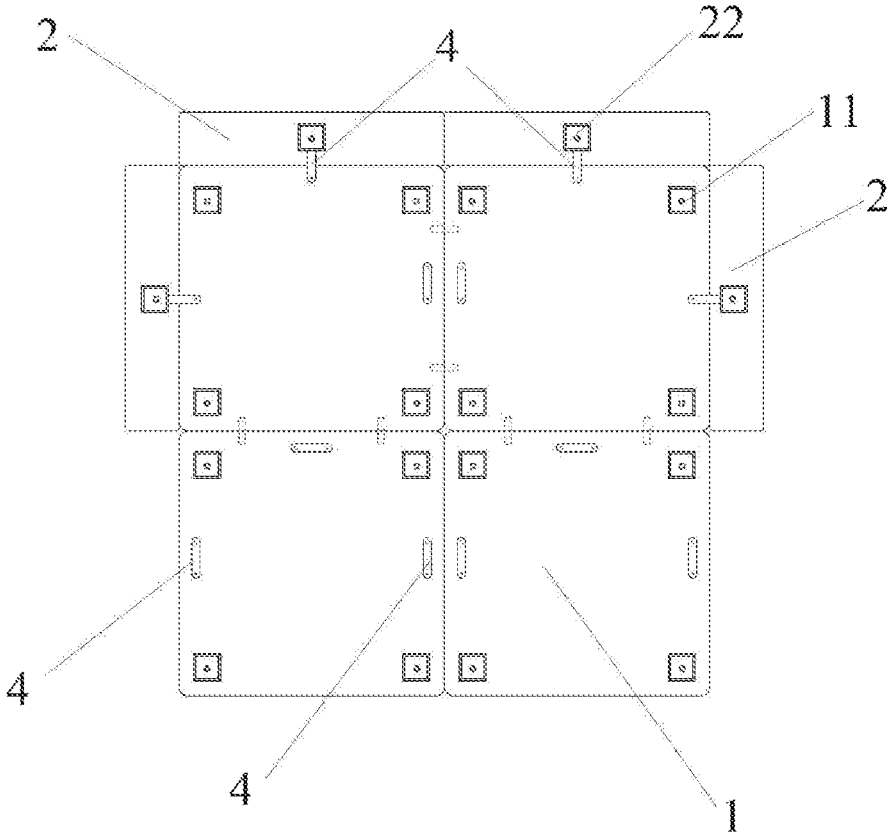
FIG. 7 is a schematic view of the structure of a bottom surface in the first embodiment of the present disclosure.
Figure 8:
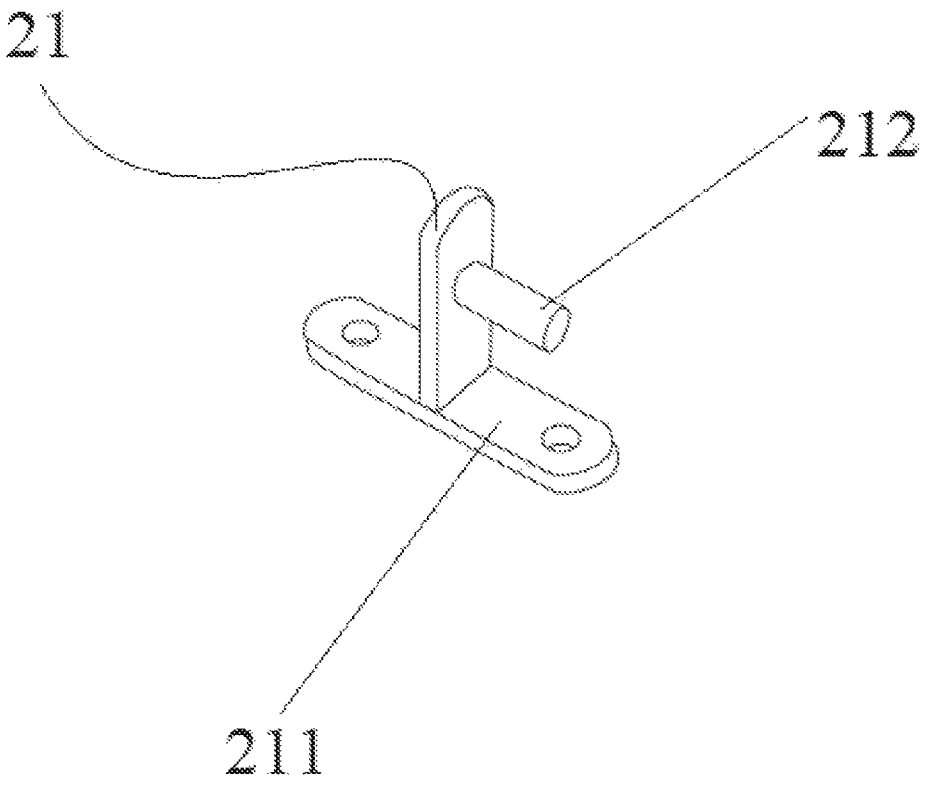
FIG. 8 is a schematic view of the structure of a hook body of the present disclosure.
Figure 9:
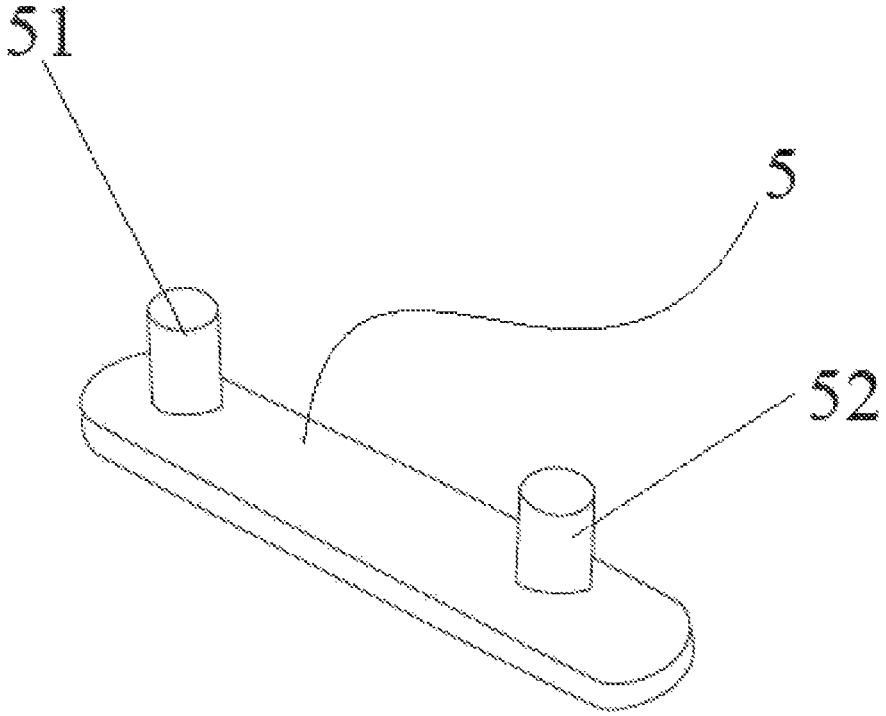
FIG. 9 is a schematic view of the structure of a U-shaped connection element of the present disclosure.
Figure 10:
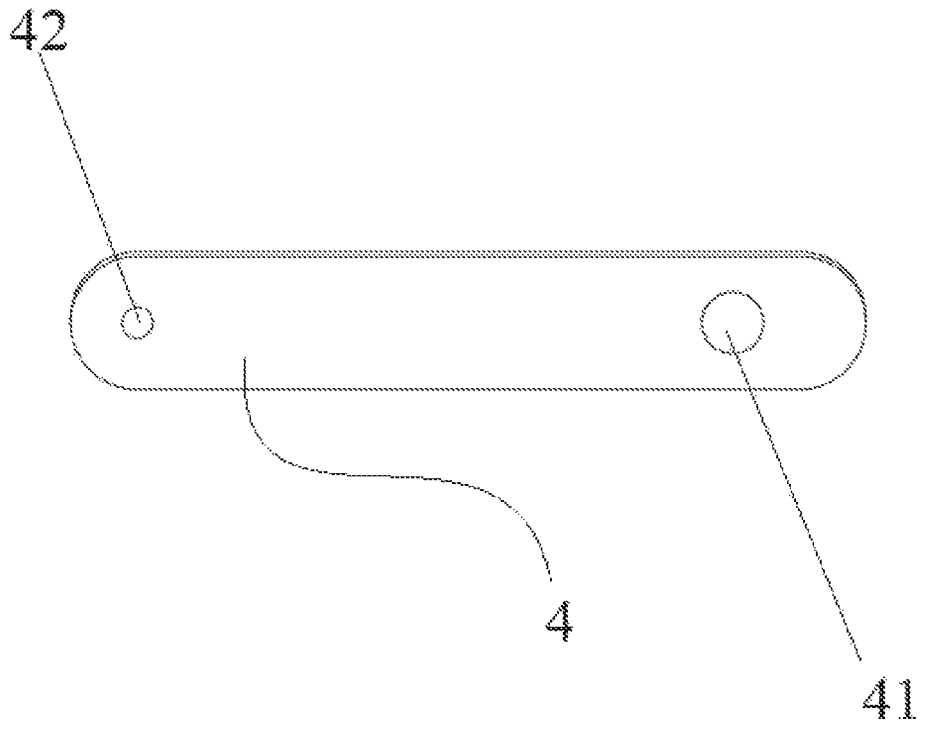
FIG. 10 is a schematic view of the structure of a position limiting piece of the present disclosure.
Figure 11:
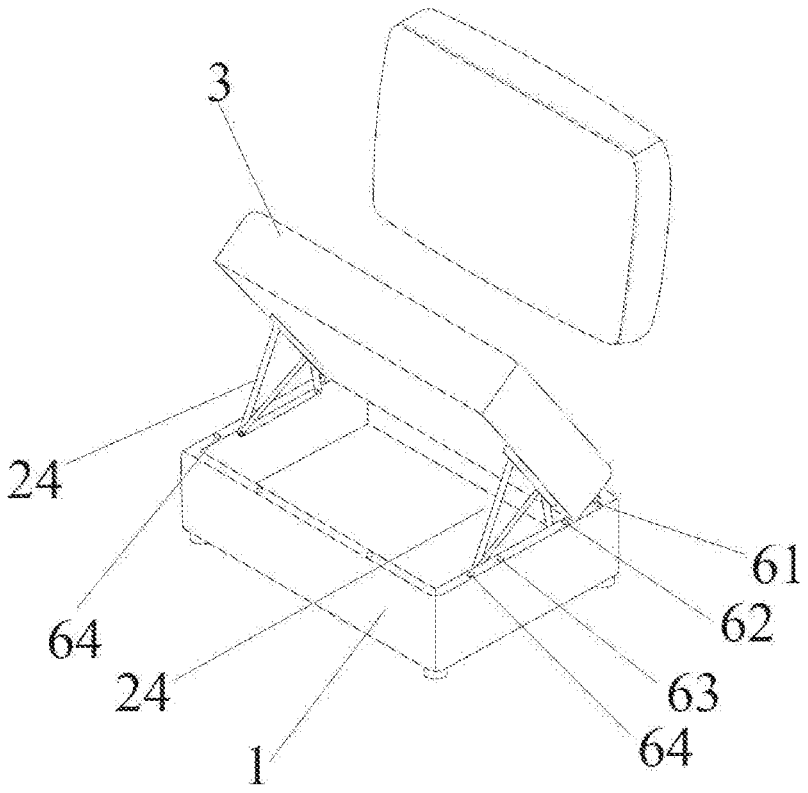
FIG. 11 is a schematic view of the structure of a bottom frame in the second embodiment of the present disclosure.
Figure 12:
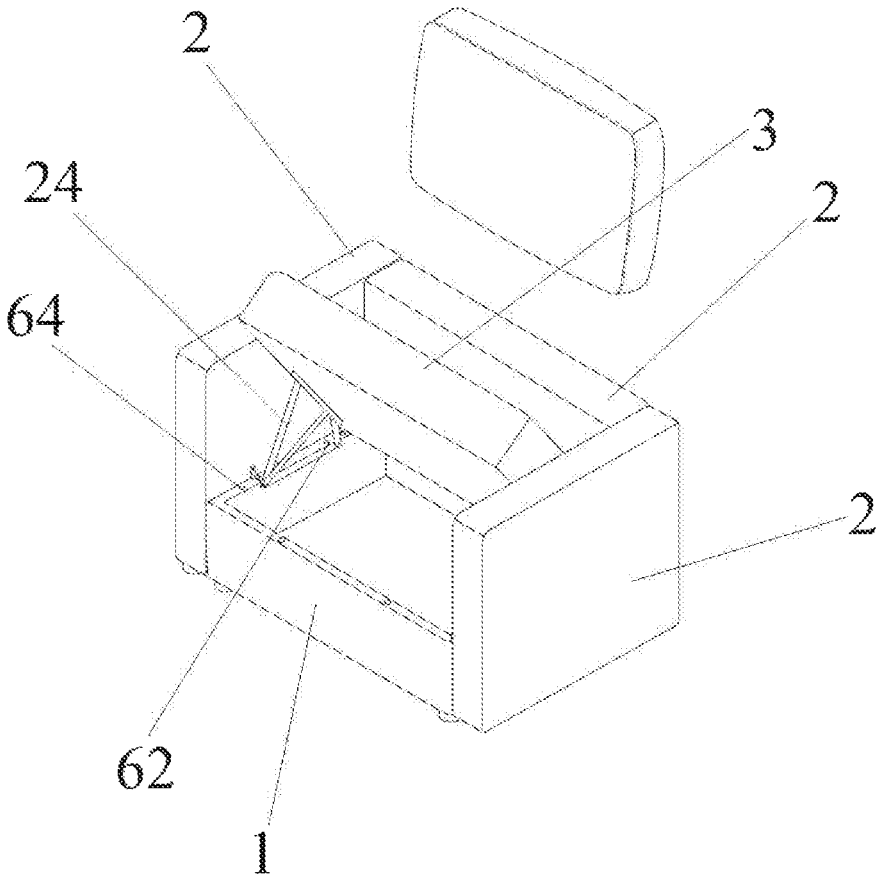
FIG. 12 is a schematic view of the connection structure of the bottom frame and the backrest frame in the second embodiment of the present disclosure.
Figure 13:
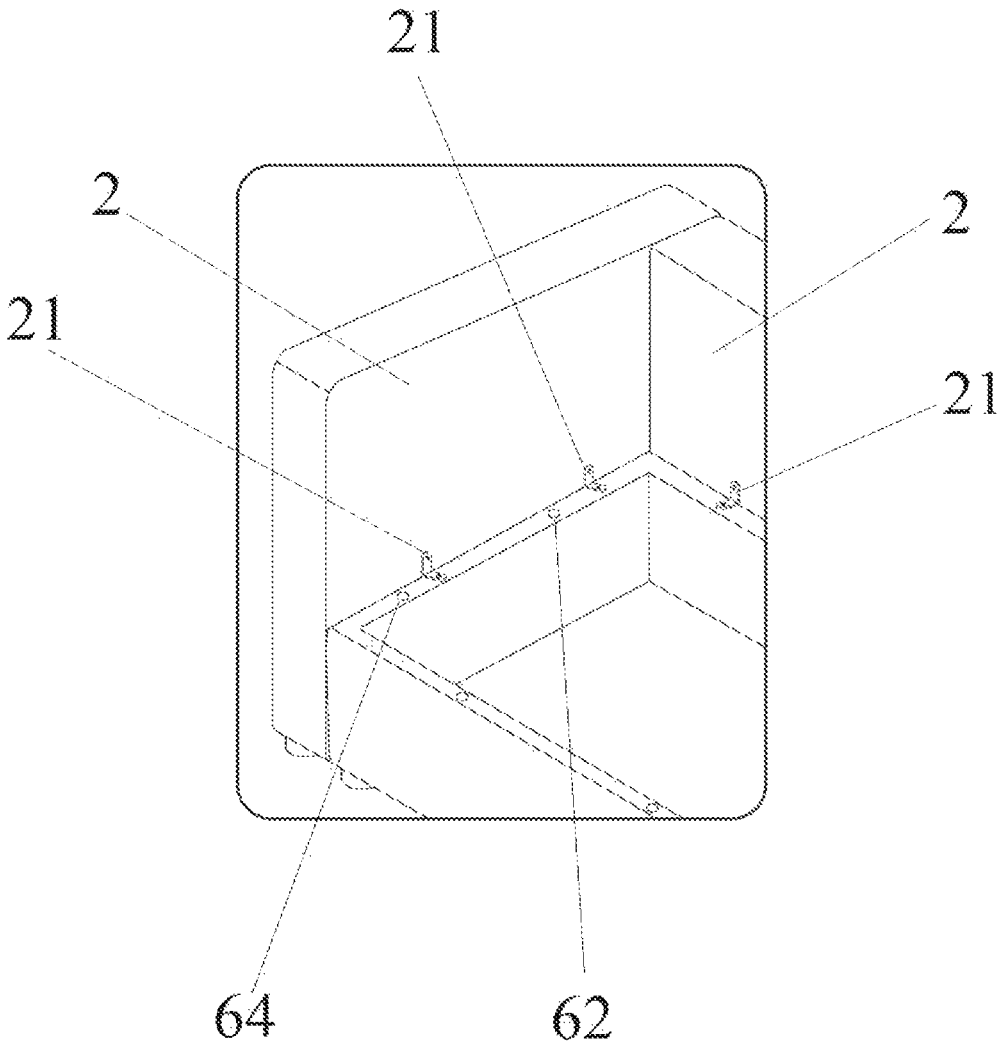
FIG. 13 is an enlarged view of a portion of the structure of the backrest frame inserted in the first and third holes of the present disclosure.
Figure 14:
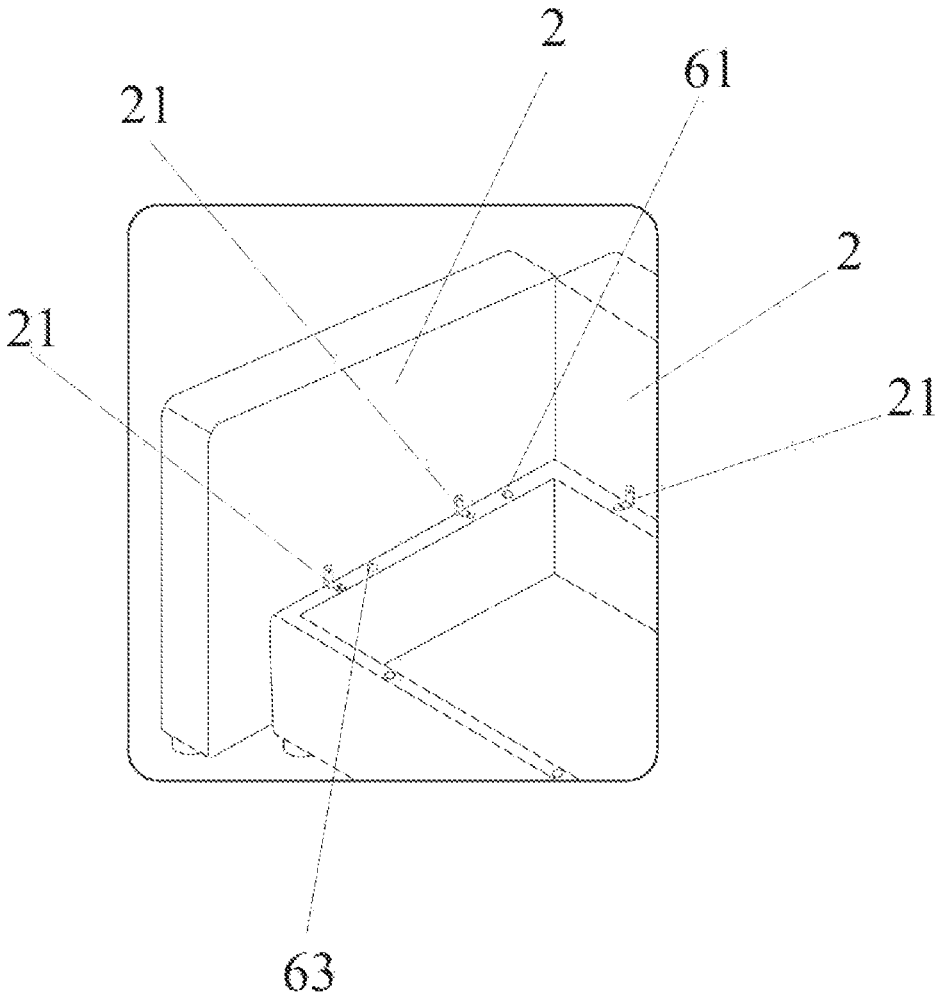
FIG. 14 is an enlarged view of a portion of the structure of the backrest frame inserted in the second and fourth holes of the present disclosure.

As shown in FIGS. 1-3, a modular sectional sofa includes a bottom frame 1, a backrest frame 2 and a cushion 3, wherein the inner side surface of the backrest frame 2 is provided with a hook body 21, the hook body 21 comprises a connection element 211, the lower surface of the connection element 211 is located at the same height as the upper surface of the bottom frame 1, the lower surface of the connection element 211 is provided with an inserting part 212, the upper surface of the bottom frame 1 is provided with a hole, the hole matches with the inserting part 212, when the inserting part 212 is connected to the hole, the backrest frame 2 is connected with the bottom frame 1 into a whole, and the cushion 3 is detachably placed on the bottom frame 1. The bottom surface of the bottom frame 1 is provided with a position limiting piece 4, the position limiting piece 4 is provided with a left position limiting hole 41 and a right position limiting hole 42, the right position limiting hole 42 is movably mounted on the bottom surface of the bottom frame 1, and the left position limiting hole 41 is fixed on the bottom surface of the backrest frame 2 through the second supporting leg 22.

As shown in FIGS. 4-9, a modular sectional sofa includes a bottom frame 1, a backrest frame 2, cushion 3 and a U-shaped connection element 5, wherein the U-shaped connection element 5 is provided with a left position limiting post 51 and a right position limiting post 52, the left position limiting post 51 is inserted into a hole or a slot of a bottom frame 1, the right position limiting post 52 is inserted into a hole or a slot of the other bottom frame 1, and two bottom frames 1 are connected together through the position limiting piece 4, so as to realize the connection of a plurality of bottom frames 1 and prevent the bottom frames 1 from disassembling due to vertical or lateral movement, resulting in the user's fall and injury.

As shown in FIGS. 10-13, a modular sectional sofa, the side edge of the bottom frame 1 is provided with a first hole 61, a second hole 62, a third hole 63 and a fourth hole 64, the backrest frame 2 is inserted into the first hole 61 and the third hole 63 or the second hole 62 and the fourth hole 64 through the hook body 21 to flexibly adjust the position of the backrest frame 2 and avoid the conflict between the backrest frames 2 when the backrest frame 2 is mounted on the bottom frame 1. When the backrest frame 2 is mounted on the cuboid bottom frame and when two backrest frames 2 need to be correspondingly mounted on the long edge on the upper surface of the cuboid bottom frame, the backrest frame 2 can be mounted in the first hole 61 and the second hole 62 through the hook body 21 as well as in the third hole 63 and the fourth hole 64, thus realizing the installation of a plurality of backrest frames 2.

The present disclosure separates the one-piece bottom frame 1 and backrest frame 2 in the conventional sofa, and then various combination can be realized by adding hook bodies 21 on the inner side surface of the backrest frame 2. When the inserting part 212 of the hook body 21 is connected on the hole or slot, the inserting part 212 is not limited to a columnar shape, and may be a sheet. The inserting part 212 matches with a hole or a slot to connect the backrest frame 2 and the bottom frame 1. Since the connection element 211 of the hook body 21 is as high as the bottom frame 1, the hook body 21 will not affect the placing of the cushion 3 on the bottom frame 1.

Two or more hook bodies 21 are usually provided, and the two or more hook bodies 21 are distributed on each side of the inner side surface of the backrest frame 2 to make the connection between the backrest frame 2 and the bottom frame 1 more stable.

The backrest frame 2 comprises one or more of a left backrest frame, a right backrest frame and a rear backrest frame. The backrest frame 2 can be arranged at a proper position according to the requirements of customers, so that unnecessary space waste is avoided.

In the connecting method of the bottom frame 1 and the backrest frame 2, the backrest frame 2 is lifted, the backrest frame 2 moves close to the bottom frame 1, the edges of the backrest frame 2 and the bottom frame 1 are aligned, the inserting part 212 is aligned to the hole or the slot of the bottom frame 1, and the inserting part 212 is inserted into the hole or the slot, thus completing the connection of the bottom frame 1 and the backrest frame 2. The inserting part 212 is inserted into the hole or slot, thereby limiting the left-right movement of the backrest frame 2. Moreover, due to the gravity, the backrest frame 2 cannot move up and down without any intentional movement, namely, the backrest frame 2 is stably connected with the bottom frame 1. On the contrary, the backrest frame 2 needs to be disassembled from the bottom frame 1, and the backrest frame 2 is intentionally lifted up and moved out of the range of the bottom frame 1.

Secondly, the bottom frame 1 is further provided with a position limiting piece 4, the position limiting piece 4 is provided with a left position limiting hole 41 and a right position limiting hole 42, the right position limiting hole 42 is movably mounted on the bottom surface of the bottom frame 1. When a plurality of bottom frames 1 are connected, the position limiting piece 4 rotates around the right position limiting piece 42 and is hidden at the bottom surface of bottom frame 1. When the bottom frame 1 and the backrest frame 2 are connected, the position limiting piece 4 rotates around the right position limiting piece 42, the left position limiting hole 41 rotates to the bottom of the backrest frame 2. The connection of the bottom frame 1 and the backrest frame 2 can be further stabilized by fixing the second supporting leg 22 to the bottom surface of the backrest frame 2. Meanwhile, the second supporting leg 22 can also support the backrest frame 2.

On the whole, the size and the weight of the sofa can be reduced, so that the convenience of sofa handling and transporting can be improved. Moreover, the sofa can be conveniently moved by disassembling, so that the house can be conveniently cleaned.

Specifically, similar to a conventional sofa, the bottom surface of the bottom frame 1 is provided with a first supporting leg 11 for supporting the bottom frame 1.

When designed, the upper surface of the position limiting piece 4 is located at the same height as the bottom surface of the backrest frame 2 to ensure that the backrest frame 2 is not able to move up and down.

The contraction manner of the position limiting piece 4 is that a rotating shaft is provided at one end of the position limiting piece 4, and the rotating shaft is fixed to the bottom surface of the bottom frame 1. Turn the position limiting piece 4 outward to make the position limiting piece 4 extend outward, and conversely turn the position limiting piece 4 inward to make the position limiting piece 4 contract.

The upper part of the backrest frame 2 is a backrest 23, and the angle of the backrest 23 is adjustable. The angle of the backrest 23 can be adjusted by the user according to the requirements of the user to improve the comfort of use.

The bottom frame 1 is provided with a storage space, which can realize the function of storing articles at home. The storage space is provided in the bottom frame 1, and the bottom frame 1 is properly covered with the cushion 3 and the cushion 3 covers the storage space, so that the storage space can be hidden in the bottom frame 1. When the cushion 3 is supported up by the support frame 24, the cushion 3 no longer covers the storage space, and the storage space is opened. Moreover, the edge of storage space can be used as a hole or slot, thus saving the step of making a slot.

In the first embodiment, four bottom frames 1 are connected together through the U-shaped connection element 5, the outer side edge of the bottom frame 1 is respectively connected with the backrest frame 2, the right position limiting hole 42 of the position limiting piece 4 is aligned with a screw hole of the bottom frame 1, the left position limiting hole 41 of the position limiting piece 4 is aligned with the bottom surface of the backrest frame and is fixed through the second supporting leg 22, and the hook body 21 of the backrest frame 2 is inserted into the hole or the slot of the bottom frame 1, so that the left backrest frame, the right backrest frame and the rear backrest frame are fixed on the bottom frame 1 to form a larger sofa for use. The sofa does not need to be additionally customized, the handling and transporting costs of the sofa are saved, the universality of a product is improved. Moreover, the position limiting piece 4 is fixed by the screw, so that the connection is stable and the sofa is not easy to fall off.

The position limiting piece 4 can rotate around the screw. When leaving the factory, the right limit position hole 42 of the position limiting piece 4 is fixed on the screw hole through the screw, the position limiting piece 4 rotates around the screw to the bottom of the bottom frame 1, and the position limiting piece 4 will not affect the user to use the bottom frame 1, so that the handling and transportation is more convenient.

In the second embodiment, the side edge of the bottom frame 1 is provided with a first hole 61, a second hole 62, a third hole 63 and a fourth hole 64, the hook body 21 of the backrest frame 2 is inserted into the first hole 61 and the third hole 63 or the second hole 62 and the fourth hole 64. The mounting position of the backrest frame 2 is changed by changing the inserting position of the hook body 21, so that the problem that the backrest frame 2 cannot be mounted due to the conflict of the mounting position of the backrest frame 2 is avoided.

In the third embodiment, when the bottom frame 1 is a cuboid, the installation position of the backrest frame 2 needs to be adjusted to match the long edge of the cuboid with the short edge of the backrest frame so as to splice the sofa Two backrest frames 2 are installed on the long edge of the bottom frame 1 through the first hole 61 and second hole 62 as well as the third hole 63 and fourth hole 64, without additional customization of the backrest frame 2, and transportation is also more convenient and cost-saving.

Therefore, the present disclosure provides a modular sectional sofa to solve the problems of the above-mentioned prior art, which can reduce the size and the weight of sofa to improve the convenience of sofa handling and transporting. Moreover, there are a variety of combination manners. The present disclosure is strongly stable after assemble and convenient for people to use.

For those skilled in the art, it is apparent that the present disclosure is not limited to the details of the above exemplary embodiments, and the present disclosure may be implemented with other forms without departing from the spirit or basic features of the present disclosure. Thus, in any way, the embodiments should be regarded as exemplary, and non-restrictive; the scope of the present disclosure is limited by the appended claims, instead of the above depiction. Thus, all variations intended to fall into the meaning and scope of equivalent elements of the claims should be covered within the present disclosure. No reference signs in the claims should be regarded as limiting the involved claims.

The invention claimed is:

1. A modular sectional sofa, characterized in that it includes a bottom frame (1), a backrest frame (2) and a cushion (3), wherein the inner side surface of the backrest frame (2) is provided with a hook body (21), the hook body (21) comprises a connection element (211), the lower surface of the connection element (211) is located at the same height as the upper surface of the bottom frame (1), the lower surface of the connection element (211) is provided with an inserting part (212), the upper surface of the bottom frame (1) is provided with a hole or slot, the hole or slot matches with the inserting part (212), when the inserting part (212) is connected to the hole or slot, the backrest frame (2) is connected with the bottom frame (1), and the cushion (3) is detachably placed on the bottom frame (1), a bottom surface of the bottom frame (1) is provided with a first supporting leg (11), and a bottom surface of the backrest frame (2) is provided with a second supporting leg (22), wherein the bottom surface of the bottom frame (1) is provided with a position limiting piece (4), the position limiting piece (4) is provided with a left position limiting hole (41) and a right position limiting hole (42), the right position limiting hole (42) is movably mounted on the bottom surface of the bottom frame (1), and the left position limiting hole (41) is fixed on the bottom surface of the backrest frame (2) through the second supporting leg (22).

2. The modular sectional sofa according to claim 1, characterized in that at least two hook bodies (21) are provided.

3. The modular sectional sofa according to claim 1, characterized in that the upper surface of the position limiting piece (4) is located at the same height as the bottom surface of the backrest frame (2).

4. The modular sectional sofa according to claim 1, characterized in that it further comprises a rotating shaft, the right position limiting hole (42) is movably mounted on the bottom surface of the bottom frame (1) through the rotating shaft.

5. The modular sectional sofa according to claim 1, characterized in that the backrest frame (2) comprises one or more of a left backrest frame, a right backrest frame and a rear backrest frame.

6. The modular sectional sofa according to claim 1, characterized in that the upper part of the backrest frame (2) is a backrest (23), and the angle of the backrest (23) is adjustable.

7. The modular sectional sofa according to claim 1, characterized in that the bottom frame (1) is provided with a storage space.

8. The modular sectional sofa according to claim 7, characterized in that the storage space is provided in the bottom frame (1), the edge of the storage space is used as the hole or the slot, the bottom frame (1) is properly covered with the cushion (3), and the cushion (3) covers the storage space.

9. The modular sectional sofa according to claim 7, characterized in that a support frame (24) is movably provided in the storage space, and when the cushion (3) is supported up by the support frame (24), the storage space is opened.

10. A modular sectional sofa, characterized in that it includes the bottom frame (1) and the backrest frame (2) according to claim 1 and a U-shaped connection element (5), wherein the U-shaped connection element (5) is provided with a left position limiting post (51) and a right position limiting post (52), the left position limiting post (51) is inserted into the hole or the slot of the bottom frame (1), the right position limiting post (52) is inserted into the hole or the slot of the other bottom frame (1), and the U-shaped connection element (5) connects the two bottom frames (1).

11. The modular sectional sofa according to claim 10, characterized in that a plurality of the bottom frames (1) are connected through the U-shaped connection element (5) to form a sofa set.

12. A modular sectional sofa, characterized in that it includes a bottom frame (1) and the backrest frame (2) according to claim 1, wherein a side edge of the bottom frame (1) is provided with four said holes, namely a first hole (61), a second hole (62), a third hole (63) and a fourth hole (64), the inner side surface of the backrest frame (2) is provided with two hook bodies (21), the two hook bodies (21) are inserted into any two holes, and the backrest frame (2) is connected with any one side of the bottom frame (1).

* * * * *